US007506763B2

(12) United States Patent
Hatcher

(10) Patent No.: US 7,506,763 B2
(45) Date of Patent: Mar. 24, 2009

(54) FOOD TRAY WITH NON-SLIP INSERTS

(75) Inventor: Ashley Hatcher, Columbus, GA (US)

(73) Assignee: Archer Innovations, LLC, Columbus, GA (US)

( * ) Notice: Subject to any disclaimer, the term of this patent is extended or adjusted under 35 U.S.C. 154(b) by 15 days.

(21) Appl. No.: 11/421,552

(22) Filed: Jun. 1, 2006

(65) Prior Publication Data

US 2007/0278126 A1 Dec. 6, 2007

(51) Int. Cl.
*B65D 25/16* (2006.01)
*A47G 19/02* (2006.01)

(52) U.S. Cl. ..... 206/565; 206/564; 220/495.03; 220/574.3; 220/575

(58) Field of Classification Search ..... 206/564, 206/565, 557–563; D7/553.5; 220/574–575, 220/495.03
See application file for complete search history.

(56) References Cited

U.S. PATENT DOCUMENTS

| | | | | | |
|---|---|---|---|---|---|
| 224,632 | A | | 2/1880 | Berry | |
| 2,878,932 | A | * | 3/1959 | Martire, Jr. | 206/564 |
| 3,231,718 | A | * | 1/1966 | Vasile | 206/557 |
| 3,305,124 | A | * | 2/1967 | Whiteford | 206/564 |
| D216,869 | S | | 3/1970 | Britt | |
| 3,808,084 | A | * | 4/1974 | Doty | 248/346.11 |
| D235,301 | S | | 6/1975 | Mountain, Jr. et al. | |
| D242,515 | S | | 11/1976 | Shumrak | |
| 4,005,745 | A | | 2/1977 | Colato et al. | |
| 4,019,022 | A | | 4/1977 | Seider et al. | |
| 4,093,041 | A | * | 6/1978 | Davis et al. | 186/45 |
| 4,194,109 | A | | 3/1980 | Springer | |
| D255,527 | S | | 6/1980 | Seager | |
| 4,737,390 | A | * | 4/1988 | Fricano et al. | 206/557 |
| 4,744,597 | A | * | 5/1988 | Bauman et al. | 294/172 |
| D335,796 | S | * | 5/1993 | Barnes | D7/553.5 |
| D335,797 | S | | 5/1993 | DeGrow | |
| 5,368,183 | A | * | 11/1994 | Singer | 220/528 |
| 5,580,037 | A | * | 12/1996 | Gore | 220/574.1 |
| 6,029,843 | A | * | 2/2000 | Kroscher et al. | 220/367.1 |
| 6,814,235 | B2 | | 11/2004 | Wang | |
| 2003/0205645 | A1 | * | 11/2003 | Kaposi | 248/37.3 |

FOREIGN PATENT DOCUMENTS

| | | | |
|---|---|---|---|
| FR | 2 653 705 | | 5/1991 |
| WO | WO 94/14361 | * | 7/1994 |

OTHER PUBLICATIONS

Notification of Transmittal of the International Search Report and the Written Opinion of the International Searching Authority, or the Declaration, dated Jul. 23, 2008.

* cited by examiner

*Primary Examiner*—Bryon P. Gehman
*Assistant Examiner*—Jerrold Johnson
(74) *Attorney, Agent, or Firm*—Hunton & Williams, LLP

(57) ABSTRACT

A tray system, comprising one or more retaining portions for a food container, the one or more retaining portions receiving and securely holding fitted non-slip inserts. The tray system includes one or more feet which are of a depth at least equal to deepest recessed retaining portion of the tray. The feet may allow the tray to sit stably on a flat surface. The tray may have a non-slip removable insert inserted into the retaining portion which may be fitted to the bottom of the retaining portion and may maintain grip on serving tray and food container.

18 Claims, 4 Drawing Sheets

FOOD TRAY WITH NON-SLIP INSERTS

FIELD OF THE INVENTION

The present invention relates to a food tray having non-slip inserts.

BACKGROUND OF THE INVENTION

Many devices exist for serving food. Some systems include indentations and surface coverings but have known drawbacks.

SUMMARY OF THE INVENTION

According to an embodiment of the present invention, a tray system is provided that comprises one or more retaining portions for a food container, the retaining portions receiving and securely holding fitted non-slip inserts. The tray system may contain one or more feet which may be of a depth at least equal to the deepest recessed portion of the tray, such that the one or more feet may allow the tray to sit stably on a flat surface. The tray system may contain one or more non-slip inserts inserted into the one or more portions, which may be fitted to the bottom of the portions. The inserts may maintain grip on the serving tray and a food container and may be removable and reusable. The removal of the inserts may facilitate ease of cleaning and prevent buildup of dirt underneath traction surfaces. The tray and inserts may be composed of materials that are dishwasher safe. The tray may be stackable. The one or more inserts may be interchangeable such that inserts from one tray may be utilized for another tray, allowing a tray's inserts to be replaced or their color to be varied. The tray may have handles at two opposite edges thereof; the handles may have a slotted portion therein for gripping.

Other advantages will be appreciated by one of ordinary skill in the art upon review of the entirety of this patent application.

DETAILED DESCRIPTION

Exemplary embodiments of the invention are discussed in detail below. While specific exemplary embodiments are discussed, it should be understood that this is done for illustration purposes only. A person skilled in the relevant art will recognize that other components and configuration can be used without departing from the spirit and scope of the invention.

Figure 1:
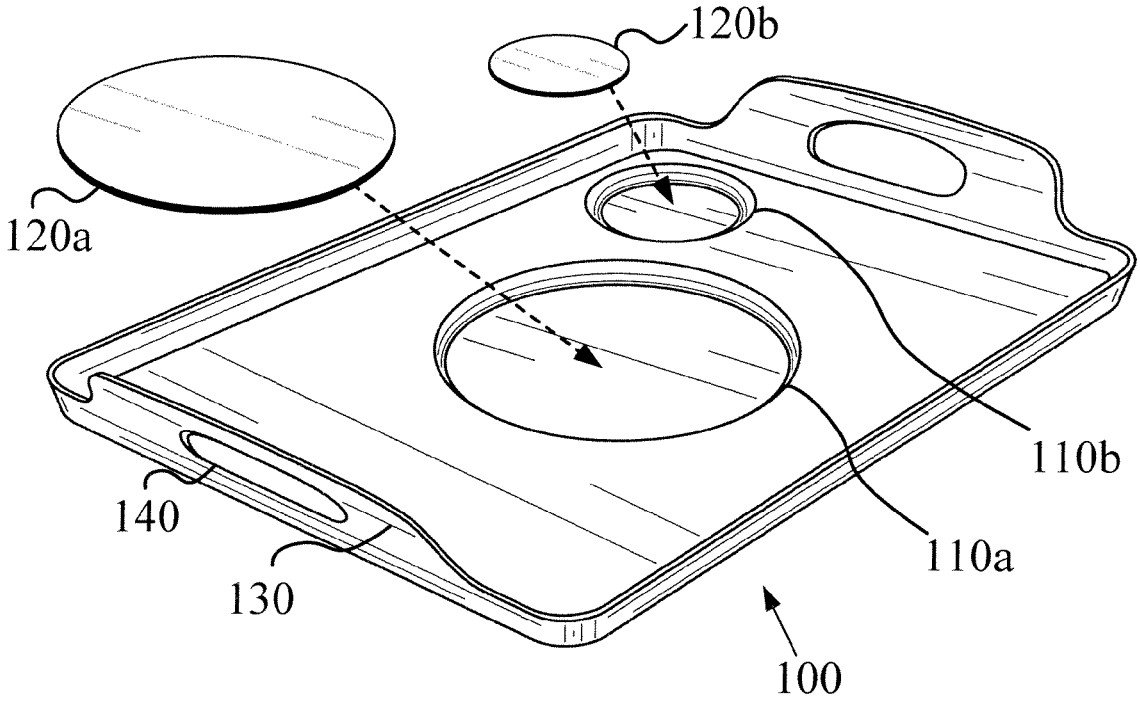
FIG. 1 depicts a top, angled view of a food tray with recessed portions and inserts according to an embodiment of the present invention.

As discussed above, various embodiments and iterations of the present invention relate to a food tray. FIG. 1 illustrates a tray 100 which has a main body including one or more retaining portions 110. In some embodiments retaining portion 110 may be recessed. In other embodiments retaining portion 110 may be formed by using one or more raised surfaces. In some embodiments the tray 110 may be composed of the chemical compound melamine. In some embodiments tray 100 may be formed using a plastic. In some embodiments the tray 100 may be composed of wood, metal, glass or other materials or some combination thereof. In some embodiments the tray 100 may be made of substances that are dishwasher safe. In some embodiments, tray 100 may comprise a tray with one or more handles 130 for gripping the tray. In one embodiment the tray may comprise a tray with handles at two opposite edges thereof; the handles may comprise a handle 130 a slotted portion 140 therein for gripping. The retaining portions 110 may be designed to receive one or more inserts 120. Inserts 120 may fit in retaining portions 110. Inserts 120 may also grip securely to tray 100. Inserts 120 may provide traction for serving containers such that when tray 100 is not level the inserts may greatly reduce the chance of container slippage. In some embodiments inserts 120 may be silicon based. In other embodiments the inserts 120 may be composed of rubber or other suitable materials or some combination thereof. In some embodiments inserts 120 may be permanently affixed to the bottom of retaining portions 110. In some embodiments inserts 120 may be composed of non-stick materials. In some embodiments inserts 120 may be removed for cleaning to prevent the buildup of dirt underneath the inserts 120. Inserts 120 may be made of substances that are dishwasher safe. Inserts 120 may subsequently be reused. Inserts 120 also may be printed in a variety of colors, with various designs or logos so that users of tray 100 may change the appearance of the tray 100 for personal taste, marketing or other reasons by switching inserts. In some embodiments the ease of removal of inserts 120 may also allow for replacement of inserts in the event an insert is worn or damaged.

Figure 2:
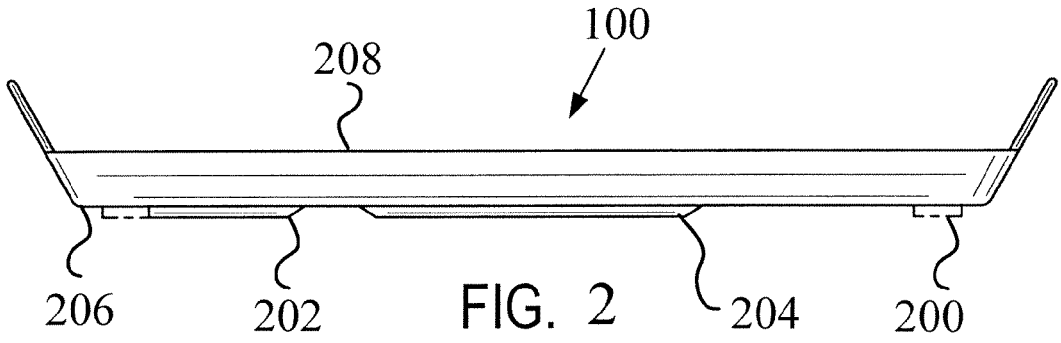
FIG. 2 depicts a side view of a food tray with recessed portions and inserts according to an embodiment of the present invention.
Figure 3:
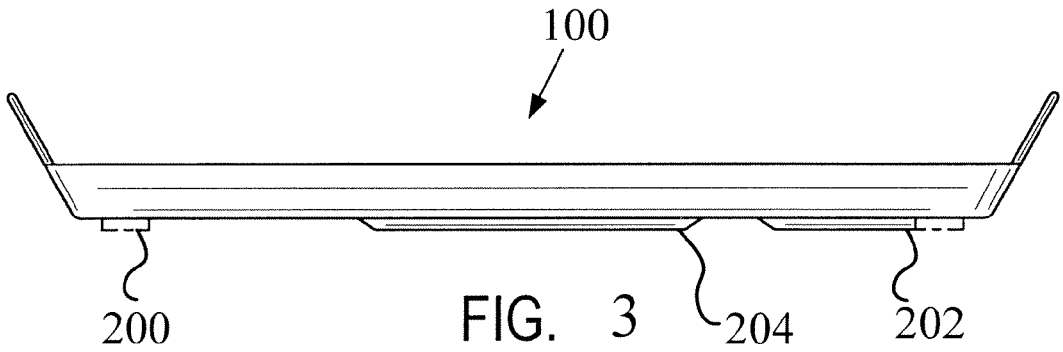
FIG. 3 depicts a side view of a food tray with recessed portions and inserts according to an embodiment of the present invention.

FIGS. 2 and 3 illustrate a side view of tray 100. Food tray 100 may comprise a tray with one or more feet 200. Feet 200 in some embodiments offset recessed portions 202 and 204 respectively such that when the tray 100 is placed on a flat surface it may sit stably. The height of feet 200 in some embodiments may be equal to or greater than the depth of the deepest recessed portion of their respective trays so that they may achieve this stability. In some embodiments tray 100 may be constructed such that the bottom 206 of tray 100 is a smaller perimeter than the perimeter of top 208 of tray 100. In such an embodiment the bottom perimeter of recessed portions 202 and 204 would also be smaller than their respective top perimeters. This embodiment may permit tray 100 to be stackable.

Figure 4:
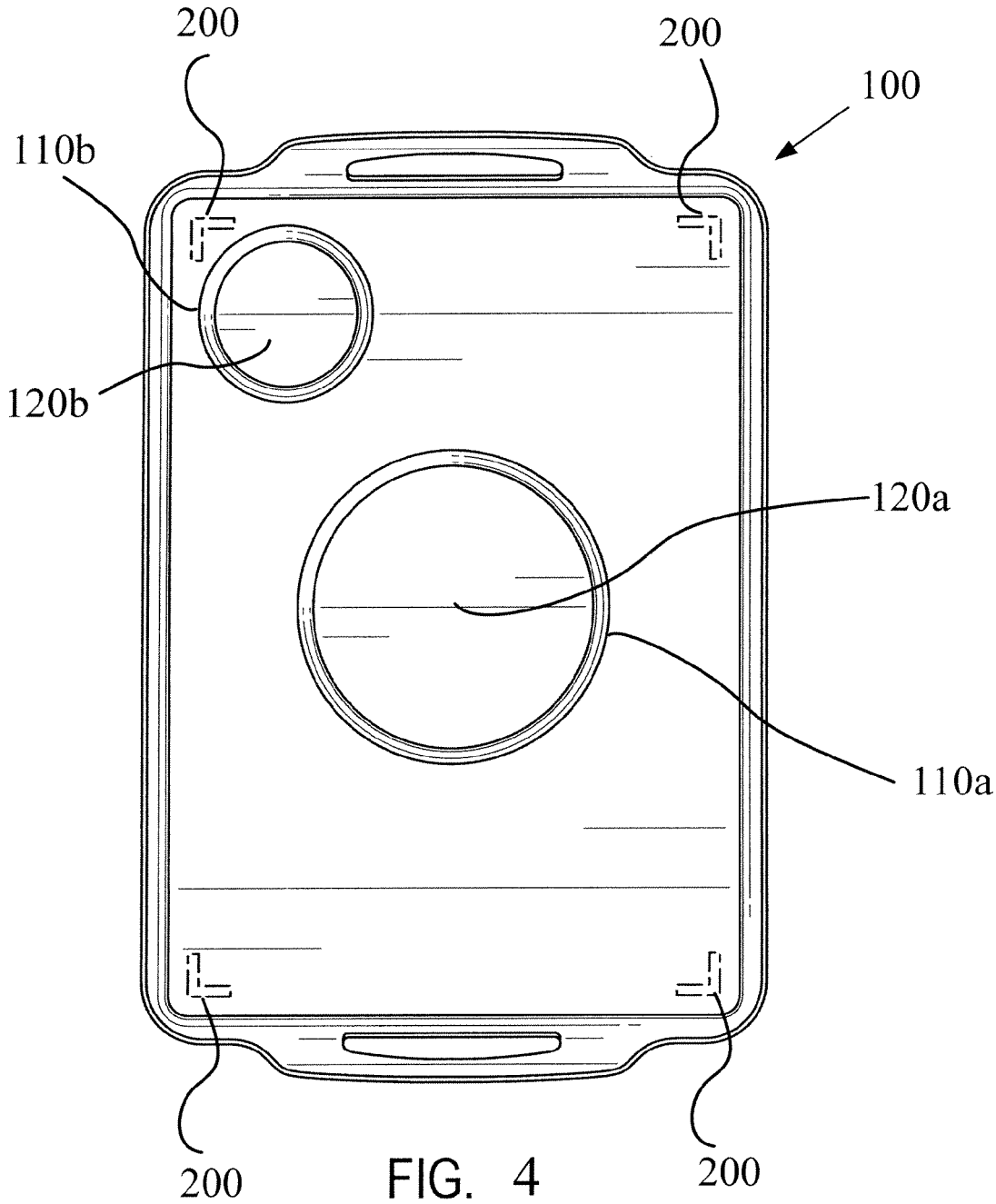
FIG. 4 depicts a top view of a food tray with recessed portions and inserts according to an embodiment of the present invention.

FIG. 4 illustrates a top view of tray. Inserts 120 are shown inserted into retaining portions 110. Some embodiments of tray 100 may be a round shape, an oval shape, a square shape or other practical shapes. Other embodiments of tray 100 may have a different arrangement or number of retaining portions. In some embodiments tray 100 may contain more than one retaining portion which may be designed for different types of serving containers. In some embodiments one retaining portion 110*b* may be designed for holding a glass or other beverage container and retaining portion 110*a* may be designed for holding a plate. One embodiment of tray 100 may contain a retaining portion for silverware. Other embodiments consider retaining portions for multiple dishes for a serving tray. Another embodiment of tray 100 contains a retaining portion for medical utensils to provide a safe, orderly arrangement during medical or dental procedures. Other embodiments of tray 100 may have retaining portions specialized to hold containers or tools particular to a specific industry. While FIG. 4 illustrates the retaining portions as circular, other shapes including square, oval or rectangular shapes may be utilized. In one embodiment of food tray 100 no retaining portion is utilized and insert 120 is designed to fit a portion or portions of the top side of the tray and to grip to the tray directly. When inserts 120 are in place in retaining portions 110 they may lay flat and may provide a even gripping surface for food containers.

Figure 5:
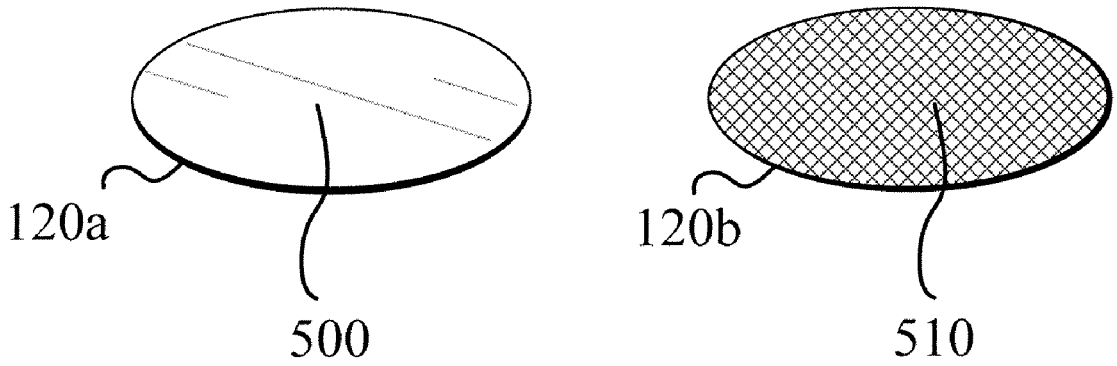
FIG. 5 depicts a view of both sides of an insert showing the smooth side and an opposite side with a raised pattern.

FIG. 5 illustrates view of both sides of insert 120 showing side 120*a* with smooth texture 500 and an opposite side 120*b* with a design 510 to facilitate grip on moist containers. In some embodiments this design may be a raised crosshatch or grid pattern. In some embodiments both sides of insert 120 may be smooth. In some embodiments both sides of insert 120 may be have a design to facilitate grip on moist containers. A variety of designs consisting of raised or grooved patterns may be utilized so that insert 120 may retain grip on a food or beverage container when the container or insert is moist. The insert 120 may be placed in the retaining portion 110 of tray 100 so that either side is facing up. If the side 120*b* is facing up it may facilitate grip on a serving container by reducing slippage of a food container if there is moisture on the insert or the food container. In some embodiments this may be used to reduce slippage of "sweating" glasses. The crosshatch pattern may be a pattern that is not significantly raised such that it does not significantly affect the appearance of the design of the insert but still reduces the slippage of moist food containers.

Some of the terminology used herein may be understood as follows:

Melamine is the chemical compound (triamino-triazine-C3N6H6), comprising carbon, nitrogen and hydrogen.

While the foregoing description includes details and specificities, it should be understood that such details and specificities have been included for the purposes of explanation only, and are not to be interpreted as limitations of the present invention. Many modifications to the embodiments described above can be made without departing from the spirit and scope of the invention, as it is intended to be encompassed by the following claims and their legal equivalents.

What is claimed is:

1. A tray system, comprising:

a serving tray comprising a substantially planar surface, the serving tray comprising:

one or more retaining portions for a food container, wherein the one or more retaining portions are formed in the surface of the tray; and at least one non-slip removable and reusable insert each comprising two opposing substantially planar sides, wherein a first side of the at least one insert is different in surface texture than a second side of the at least one insert, wherein the at least one insert is of a substance that is dishwasher safe, and wherein the least one insert is insertable into the one or more retaining portions for maintaining grip of the at least one insert on the serving tray at the one or more retaining portions and to a bottom surface of a food container.

2. The tray system of claim 1 wherein the one or more retaining portions are recessed.

3. The tray system of claim 2 wherein the serving tray further comprises one or more feet, wherein the one or more feet are of a height at least equal to a depth of the one or more retaining portions of the serving tray, wherein the one or more feet allow the serving tray to sit stably on a flat surface.

4. The tray system of claim 1 wherein the at least one insert comprises silicon.

5. The tray system of claim 1 wherein the tray comprises melamine.

6. The tray system of claim 1 wherein a first side of the two substantially planar sides is smooth and a second side of the two substantially planar sides is one of raised and grooved.

7. The tray system of claim 1 wherein the at least one insert further comprises a logo on at least one of the two substantially planar sides.

8. The tray system of claim 1 wherein the at least one insert further comprises a decorative design on at least one of the two substantially planar sides.

9. The tray system of claim 1 further comprising a second serving tray, wherein the serving tray and the second serving tray are stackable.

10. The tray system of claim 1 wherein the serving tray is composed of substances that are dishwasher safe.

11. The tray system of claim 1 wherein the at least one insert is interchangeable with other trays.

12. The tray system of claim 1 wherein the serving tray further comprises a handle at two opposite edges thereof, the handles having a slotted portion therein for gripping.

13. A food tray, comprising:

one or more recessed portions for a food container;

one or more feet which are of a height at least equal to a deepest recessed portion of the tray, wherein the one or more feet allow the tray to sit stably on a flat surface; and one or more non-slip inserts inserted into and fitted to the one or more recessed portions; wherein:

each of the one or more non-slip inserts comprises two opposing substantially planar sides such that a first side of the non-slip insert maintains grip on the food tray and a side of second the non-slip insert maintains grip to a bottom surface of a food container each side having a different surface texture than the other;

the one or more non-slip inserts are removable and reusable;

the food tray is made of substances that are dishwasher safe;

the one or more non-slip inserts are made of substances that are dishwasher safe; and the food tray is stackable with additional food trays.

14. The food tray of claim 13 wherein at least one of the one or more non-slip inserts is composed of silicon.

15. The food tray of claim 13 wherein a food tray comprises melamine.

16. A lap tray, comprising:

one or more recessed portions for a food container;

one or more feet which are of a height at least equal to deepest recessed retaining portion of the tray, wherein the one or more feet allow the tray to sit stably on a flat surface; and one or more non-slip silicon-based inserts each comprising two opposing substantially planar sides insertable into the one or more recessed portions; wherein:

a first side of the two substantially planar sides maintains grip on the lap trap tray and a second side of the two substantially planar sides maintains grip to a bottom of a food container;

wherein the first side is different in surface texture than the second side; and the one or more non-slip silicon-based inserts are removable and reusable.

17. A food tray, comprising:

a planar surface having one or more recessed portions for receiving a food container, the food tray being made of a substance that is dishwasher safe; and one or more substantially planar removable and reusable non-slip inserts inserted into and fitted to the one or more recessed portions for maintaining a non-slip grip on a food container and the tray, the one or more inserts being made from dishwasher safe substance the one or more inserts each having a smooth side and an opposite side with one of a raised and grooved surface, and either side of the one or more inserts being capable of providing a non-slip grip on a food container.

18. The food tray of claim 17, wherein the food tray contains one or more feet which are of a depth at least equal to a deepest recessed portion of the tray, said one or more feet allowing the tray to sit stably on a flat surface.

* * * * *